US009570817B1

(12) United States Patent
Wang et al.

(10) Patent No.: US 9,570,817 B1
(45) Date of Patent: Feb. 14, 2017

(54) ELECTRICAL CONNECTOR FOR RECEIVING AN ELECTRICAL WIRE

(71) Applicant: Molex, LLC, Lisle, IL (US)

(72) Inventors: Jin Shun Wang, Shanghai (CN); Hao Yin, Shanghai (CN); Xue-Qing Zhang, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/155,756

(22) Filed: May 16, 2016

(30) Foreign Application Priority Data

May 18, 2015 (CN) ..... 2015 1 0252598

(51) Int. Cl.

| | |
|---|---|
| ***H01R 4/24*** | (2006.01) |
| ***H01R 4/26*** | (2006.01) |
| ***H01R 11/20*** | (2006.01) |
| ***H01R 4/48*** | (2006.01) |

(52) U.S. Cl.
CPC ..... *H01R 4/4818* (2013.01)

(58) Field of Classification Search
CPC ..... H01R 4/48; H01R 4/489; H01R 4/4809; H01R 4/4818; H01R 4/4836; H01R 4/4845; H01R 24/48; H01R 24/28; H01R 13/422
USPC ..... 439/856, 725, 852, 439, 438, 437, 436,439/441, 835
See application file for complete search history.

(56) References Cited

U.S. PATENT DOCUMENTS

| | | | | |
|---|---|---|---|---|
| 4,713,020 | A | 12/1987 | Awano et al. | |
| 5,083,947 | A | 1/1992 | Dominique et al. | |
| 5,902,142 | A | 5/1999 | Kondo et al. | |
| 6,783,385 | B2 | 8/2004 | Rudy | |
| 7,507,107 | B2 | 3/2009 | Tuerschmann et al. | |
| 8,328,586 | B2 * | 12/2012 | Bies | H01R 4/4836 439/725 |
| 8,591,271 | B2 * | 11/2013 | Bies | H01R 4/4836 439/725 |
| 8,721,376 | B1 * | 5/2014 | Bishop | H01R 12/57 439/441 |
| 8,882,533 | B2 * | 11/2014 | Brandberg | H01R 13/193 439/441 |
| 8,968,022 | B2 * | 3/2015 | Mostoller | H01R 4/4836 439/438 |
| 9,209,530 | B2 * | 12/2015 | Gassauer | H01R 4/4836 |
| 9,263,822 | B2 * | 2/2016 | Wu | H01R 13/2407 |
| 9,306,297 | B2 * | 4/2016 | Bishop | H01R 4/4818 |
| 9,444,155 | B2 * | 9/2016 | Chen | H01R 4/48 |

(Continued)

FOREIGN PATENT DOCUMENTS

| | | |
|---|---|---|
| EP | 1182750 A2 | 2/2002 |
| TW | M248055 U | 10/2004 |

*Primary Examiner* — Hae Moon Hyeon
(74) *Attorney, Agent, or Firm* — James A. O'Malley

(57) ABSTRACT

An electrical connector includes a housing and a conductive terminal. The housing includes a terminal slot and an insertion entrance in front of the terminal slot. The conductive terminal is correspondingly mounted in the terminal slot. The conductive terminal comprises a base portion, two side portions and two elastic arms, the base portion extends in a front-rear direction, the two side portions extend upwardly respectively at two sides of a rear end of the base portion, the two elastic arms extend respectively from the two side portions toward the insertion entrance of the housing so that a front end of each elastic arm is close to the insertion entrance. As depicted, a clamping portion is formed close to the front end of each elastic arm by punching a tab therein.

14 Claims, 15 Drawing Sheets

(56) References Cited

U.S. PATENT DOCUMENTS

| | | | | |
|---|---|---|---|---|
| 9,472,871 | B2 * | 10/2016 | Lin | H01R 4/4836 |
| 9,484,639 | B1 * | 11/2016 | Chen | H01R 4/4845 |
| 2016/0049745 | A1 * | 2/2016 | Jin | H01R 4/4836<br>439/733.1 |
| 2016/0099528 | A1 * | 4/2016 | Lin | H01R 12/53<br>439/638 |

* cited by examiner

ELECTRICAL CONNECTOR FOR RECEIVING AN ELECTRICAL WIRE

RELATED APPLICATIONS

This application claims priority to Chinese Application No. 201510252598.8, filed May 18, 2015, which is incorporated herein by reference in its entirety.

TECHNICAL FIELD

The present disclosure relates to an electrical connector.

BACKGROUND ART

Chinese patent application CN201110077533.6 (corresponding to U.S. Pat. No. 8,328,586 and corresponding to Taiwanese patent application TW100108564) discloses an electrical connection terminal. The electrical connection terminal comprises a contact frame, the contact frame comprises side walls, the side walls are designed in form of leaf spring, a tail end of an electrical wire stripped off an insulating layer may be held between two side walls of the contact frame in form of channel. The leaf spring is formed by bending a plate material, a free tail end of the leaf spring forms a clamping edge, and two clamping edges facing each other form a clamping portion for the electrical wire.

However, in the above patent application, the leaf springs at two sides of the contact frame extend toward a wire insertion direction, that is, extends opposite to or away from an electrical wire introduction entrance. Because the clamping edge is positioned away from the electrical wire introduction entrance, the tail end (center conductor) of the electrical wire stripped off the insulating layer is relative long, or else the tail end is not easily inserted into a position to be clamped, but the relative long tail end is easily distorted and deformed during insertion. Moreover, because a relative long tail end is required, such an electrical connection terminal cannot allow a center conductor, which is relative soft and stripped off an insulating layer, to be inserted, such as a center conductor of a strand wire. Thus, certain individuals would appreciate further improvements in an electrical connector.

SUMMARY OF THE INVENTION

In an embodiment, an electrical connector which comprises a housing and a conductive terminal. The housing includes a terminal slot and an insertion entrance in front of the terminal slot. The conductive terminal is correspondingly mounted to the terminal slot. The conductive terminal comprises a base portion, two side portions and two elastic arms, the base portion extends in a first direction, the two side portions extend upwardly respectively at two sides of a rear end of the base portion, the two elastic arms extend respectively from the two side portions toward the insertion entrance of the housing along the first direction, a front end of each elastic arm is close to the insertion entrance and a clamping portion can be formed close to the front end of each elastic arm by punching a tab in each elastic arm.

In another embodiment, an electrical connector is provided for use in receiving an inserted electrical wire. The electrical connector comprises a housing and a conductive terminal. The housing includes a terminal slot and an insertion entrance in front of the terminal slot for insertion of a conductor of the electrical wire. The conductive terminal is mounted to the terminal slot. The conductive terminal comprises a base portion, two side portions and two elastic arms. The base portion extends in a first direction and the two side portions extend upwardly respectively at two sides of a rear end of the base portion while the two elastic arms extend respectively from the two side portions toward the insertion entrance of the housing. The terminal is configured so that a front end of each elastic arm is close to the insertion entrance and a clamping portion is formed close to the front end of the elastic arms by punching a tab in each elastic arm. As can be appreciated, the clamping portions are used to clamp a part of the conductor of the electrical wire that has stripped off an insulating layer.

BRIEF DESCRIPTION OF THE DRAWINGS

The various respects of the present disclosure may be best understood by the following detailed description taken in connection with the accompanying Figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclose content provides various embodiments or exemplifications used to implement various features of the present disclosure. Specific examples of elements and arrangements are described as follows, so as to simplify the disclosed content of the present disclosure. These are merely examples and are not used to limit the present disclosure. For example, in the following description, that a first feature is formed on or above a second feature may comprise an embodiment that the first feature and the second are formed to directly contact with each other and may also comprise an embodiment that other feature is formed between the first feature and the second feature such that the first feature and the second feature do not directly contact each other.

Moreover, the present disclosure may use spatial corresponding terminologies, such as "below", "lower than", "relative lower", "higher than", "relative high" and the like, so as to describe a relationship between an elements or feature and another element or feature. Spatial corresponding terminologies are used to comprise various orientations of an apparatus in use or operation besides orientations illustrated in Figures. Or the apparatus may be orientated (rotated by 90 degrees or at other orientation), and the corresponding spatial description in the present disclosure may be correspondingly explained. It should be understood that, when a feature is formed to another feature or above a board, other feature may presented between them.

As can be appreciated, an advantages of the present disclosure includes the fact that the electrical connector comprises a housing with a conductive terminal that has clamping portions formed close to the insertion entrance of the housing. This allows for an inserted conductor to be clamped within a short distance of the insertion entrance. As a result, the conductor of the electrical wire is less likely to be distorted and/or deformed when the conductor is inserted. Moreover, because the clamping portion is close to the insertion entrance of the housing, the electrical connector can be more readily used with a variety of wire constructions such as a solid conductor, a stranded wire or other electrical wire configures.

Figure 1:
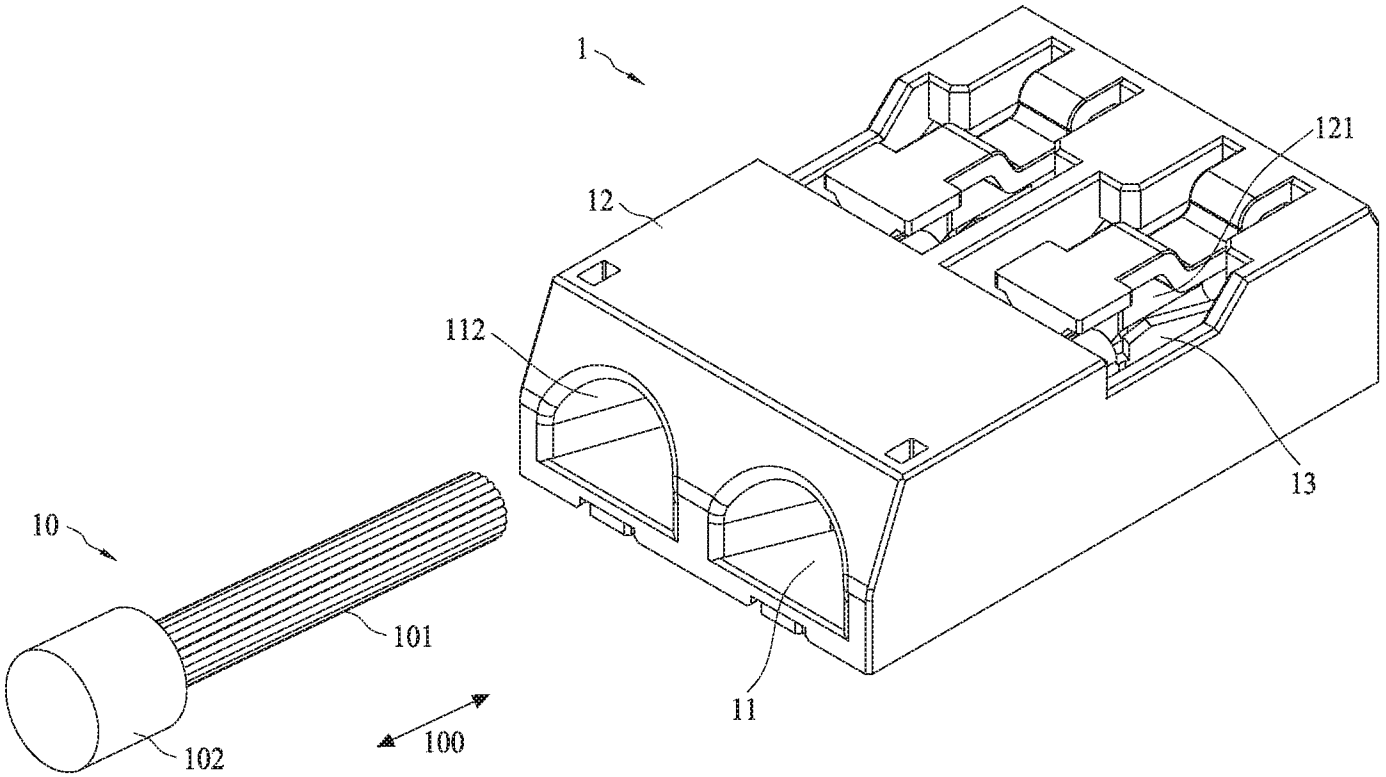
FIG. 1 is a perspective view of an embodiment of an electrical connector and an electrical wire.
Figure 2:
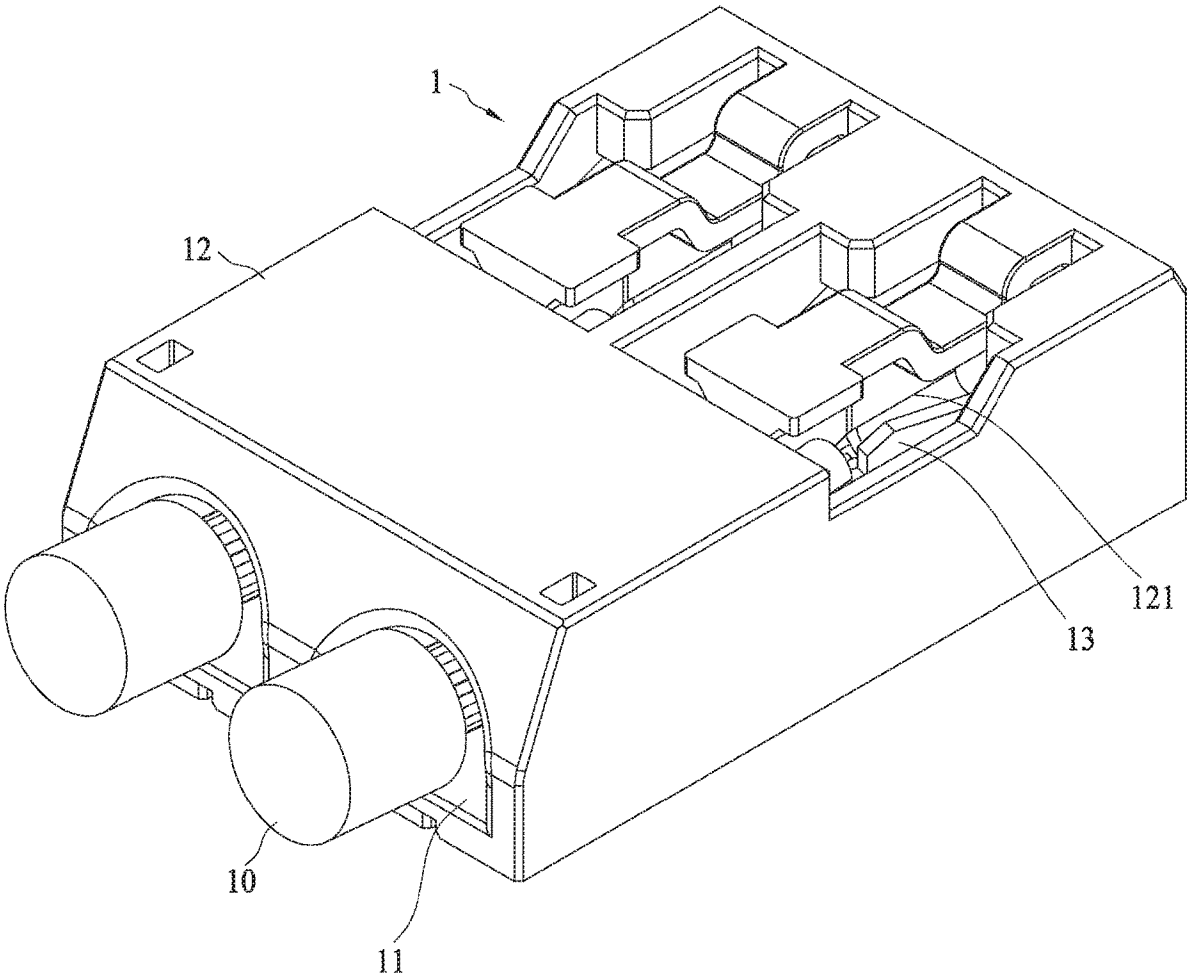
FIG. 2 is a perspective view of the embodiment depicted in FIG. 1 with the electrical wire inserted into the electrical connector.

FIG. 1 and FIG. 2 are perspective views of an embodiment of an electrical connector 1 and an electrical wire 10. The electrical connector 1 is used to electrically connect at least one individual electrical wire 10 to a board (for example, a circuit board, which is not shown). While the depicted embodiment shows two insertion entrances 11, in some embodiments, the electrical connector 1 may have one or some other number of insertion entrances 11 for insertion of one individual electrical wire 10. The electrical wire 10 comprises a conductor 101 and an outer insulating layer 102, the conductor 101 is inserted into or pulled out from the insertion entrance 11 of the electrical connector 1 along an insertion direction 100. In some embodiments, the insertion entrance 11 of a housing 12 comprises an inner wall surface 112 tapering rearwardly. The tapering inner wall surface 112 may guide the electrical wire 10 so as to allow the electrical wire 10 to be smoothly inserted into the electrical connector 1 via the insertion entrance 11.

Figure 3:
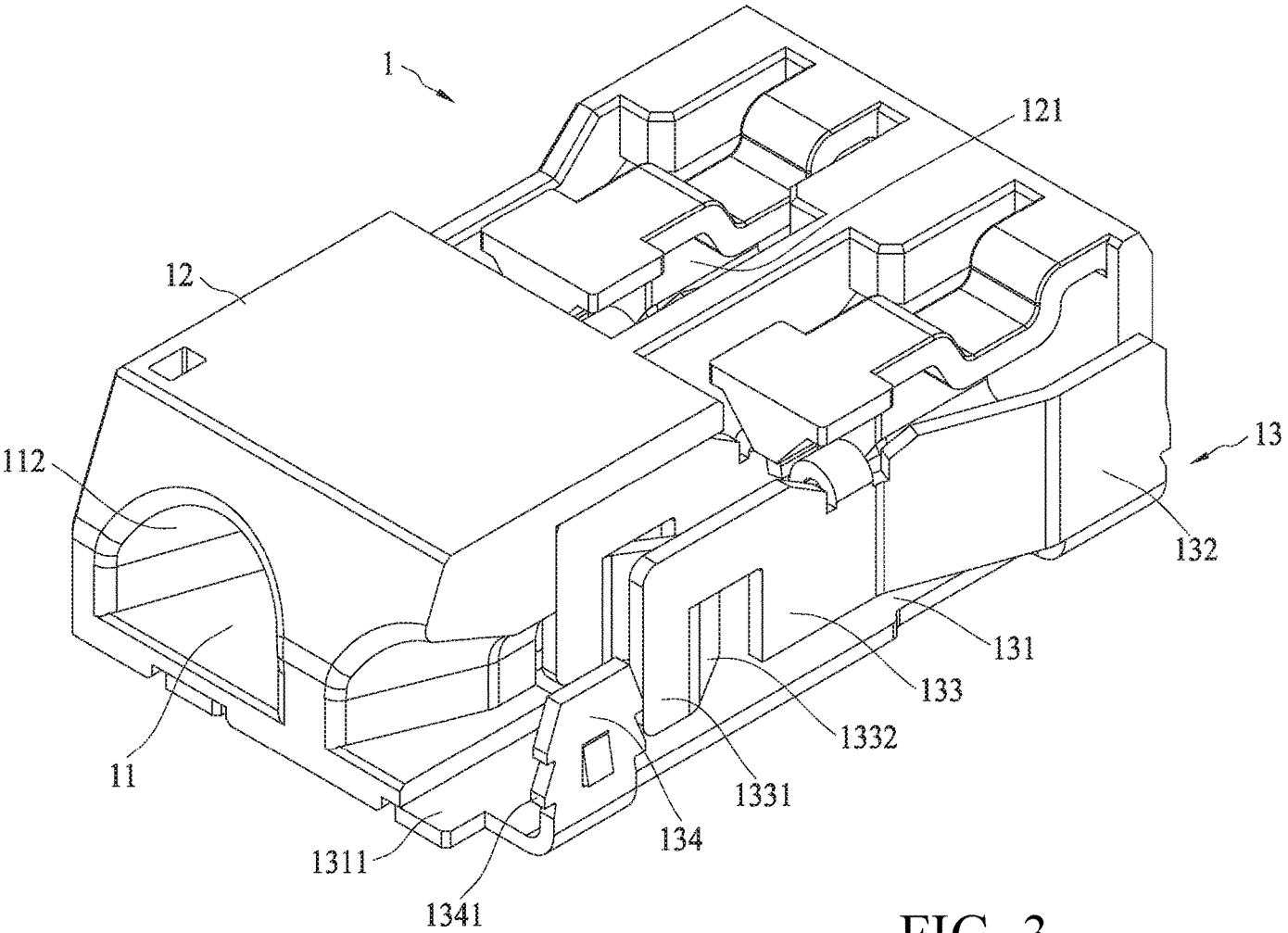
FIG. 3 is a partially cut-away perspective view of the embodiment depicted in FIG. 1.
Figure 4:
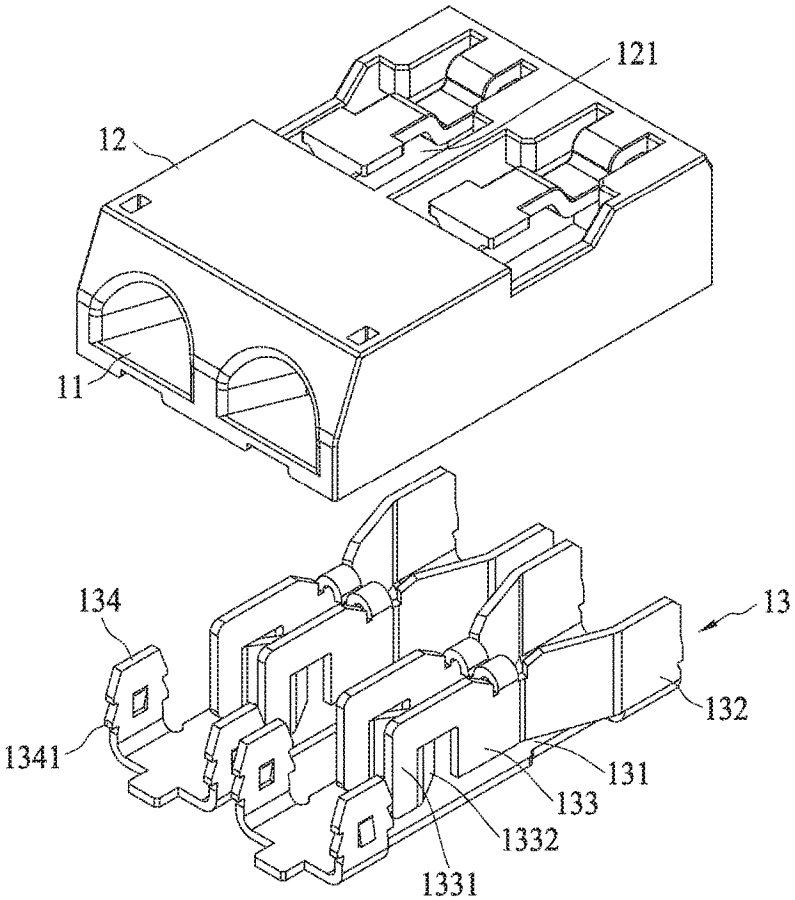
FIG. 4 is an exploded perspective view of the embodiment depicted in FIG. 1.
Figure 5:
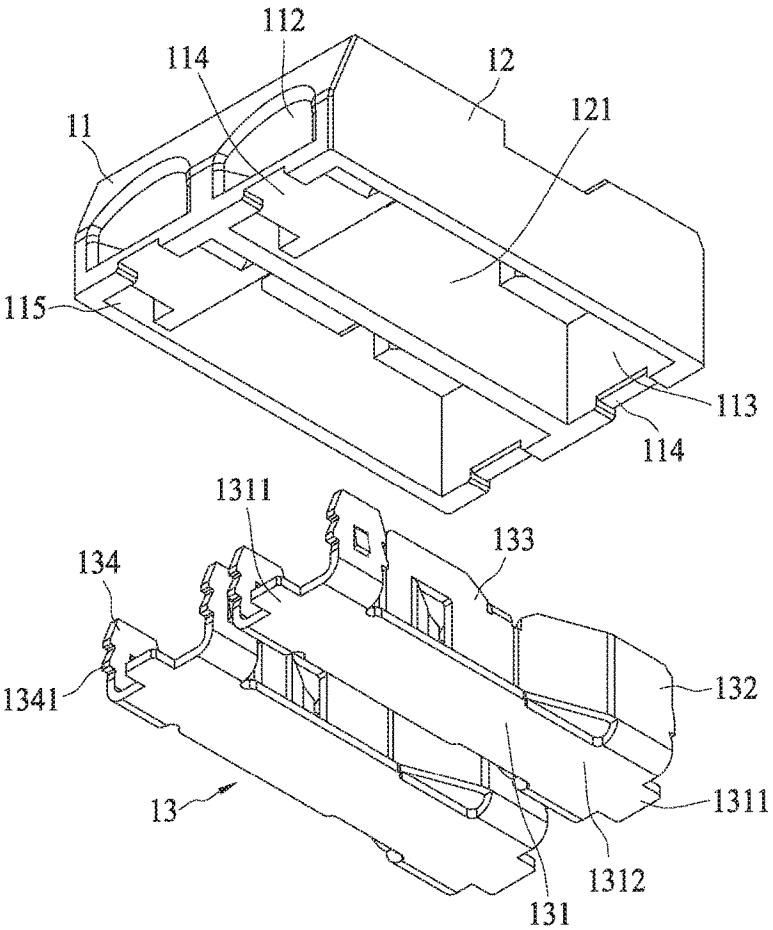
FIG. 5 is another exploded perspective view of the electrical connector depicted in FIG. 4.

FIGS. 3-5 illustrate additional features. In some embodiments, the electrical connector 1 comprises a housing 12 and at least one conductive terminal 13 fixed to the housing 12. The housing 12 comprises at least one terminal slot 121 correspondingly provided behind the insertion entrance 11. Each conductive terminal 13 is correspondingly mounted in a terminal slot 121. In some embodiments, a bottom of the housing 12 defines an opening 113 such that the conductive terminal(s) 13 may be mounted into the corresponding terminal slot 121 via the opening 113.

The conductive terminal 13 comprises a base portion 131, two side portions 132 and two elastic arms 133, here the two side portions 132 are connected to the base portion 131, and two elastic arms 133 are respectively connected to the two side portions 132. In some embodiments, the base portion 131 may be a plate-shape extending in a front-rear direction along the insertion direction 100. In some embodiments, a front end and a rear end 1312 of the base portion 131 each are provided with a stopping portion 1311. The stopping portion 1311 may be stopped on the housing 12 when the conductive terminal 13 is mount, which may help the conductive terminal 13 to be mounted at a desired position. In some embodiments, the housing 12 comprises two recessed portions 114, the two recessed portions 114 correspond to and receive the two stopping portions 1311 of the base portion 131 respectively.

In some embodiments, the two side portions 132 extend upwardly respectively from two sides of the rear end 1312 of the base portion 131. In some embodiments, the two side portions 132 may be formed by bending upwardly two plate pieces from the two opposite sides of the base portion 131, extending and facing each other. In some embodiments, the two elastic arms 133 extend respectively from the two side portions 132 toward the insertion entrance 11 of the housing 12 in a rear-to-front direction, therefore a front end 1331 of each elastic arm 133 is close to the insertion entrance 11. A clamping portion 1332 is formed close to the front end 1331 of each elastic arm 133 by punching inwardly a tab in each elastic arm 133. The clamping portion 1332 is used to clamp the conductor 101 of the electrical wire 10. Because the clamping portion 1332 is formed at the position close to the front end 1331 of the elastic arm 133, the clamping portion 1332 is close to the insertion entrance 11 of the housing 12, so that the conductor 101 of the electrical wire 10 can be clamped by the two clamping portions 1332 within a short distance by which the conductor 101 of the electrical wire 10 is inserted into the electrical connector 1, thus the electrical wire 10 need not reserve a too long part of the conductor 101 stripped off the insulating layer 102. A relative short part of the conductor 101 stripped off the insulating layer 102 will not easily distorted and deformed when the conductor 101 is inserted, therefore the electrical wire 10 is more easily inserted. Moreover, because the relative short part of the conductor 101 stripped off the insulating layer 102 may be inserted, the electrical connector 1 can be applicable to various electrical wires, such as an electrical wire formed of a solid conductor, a stranded wire or other wire configurations.

In some embodiments, the conductive terminal 13 comprises at least one a fixed piece 134, and the housing 12 correspondingly comprises at least one fixing groove 115. The fixed piece 134 may be fixed in the fixing groove 115 so as to allow the conductive terminal 13 to be fixed to the housing 12. In some embodiments, each fixed piece 134 comprises at least one protrusion 1341, the protrusion 1341 may be interference fitted with a groove wall of the fixing groove 115 so as to allow the fixed piece 134 to be fixed in the fixing groove 115. In some embodiments, each fixed piece 134 comprises a plurality of protrusions 1341, here the plurality of protrusions 1341 are provided to a side edge of each fixed piece 134, or respectively provided to two opposite side edges of each fixed piece 134. In some embodiments, the conductive terminal 13 comprises two fixed pieces 134, and the housing 12 correspondingly comprises the two fixing groove 115.

Figure 6:
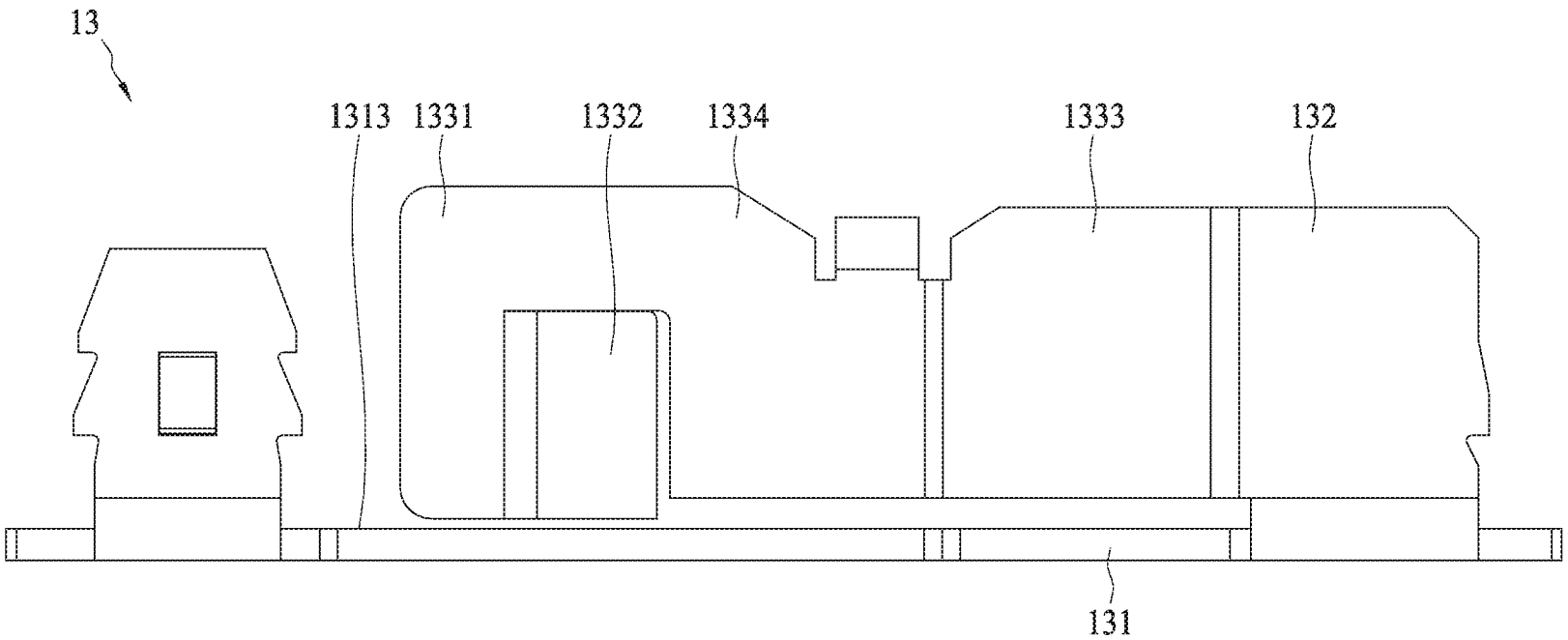
FIG. 6 is an elevated side view of an embodiment of a conductive terminal.
Figure 7:
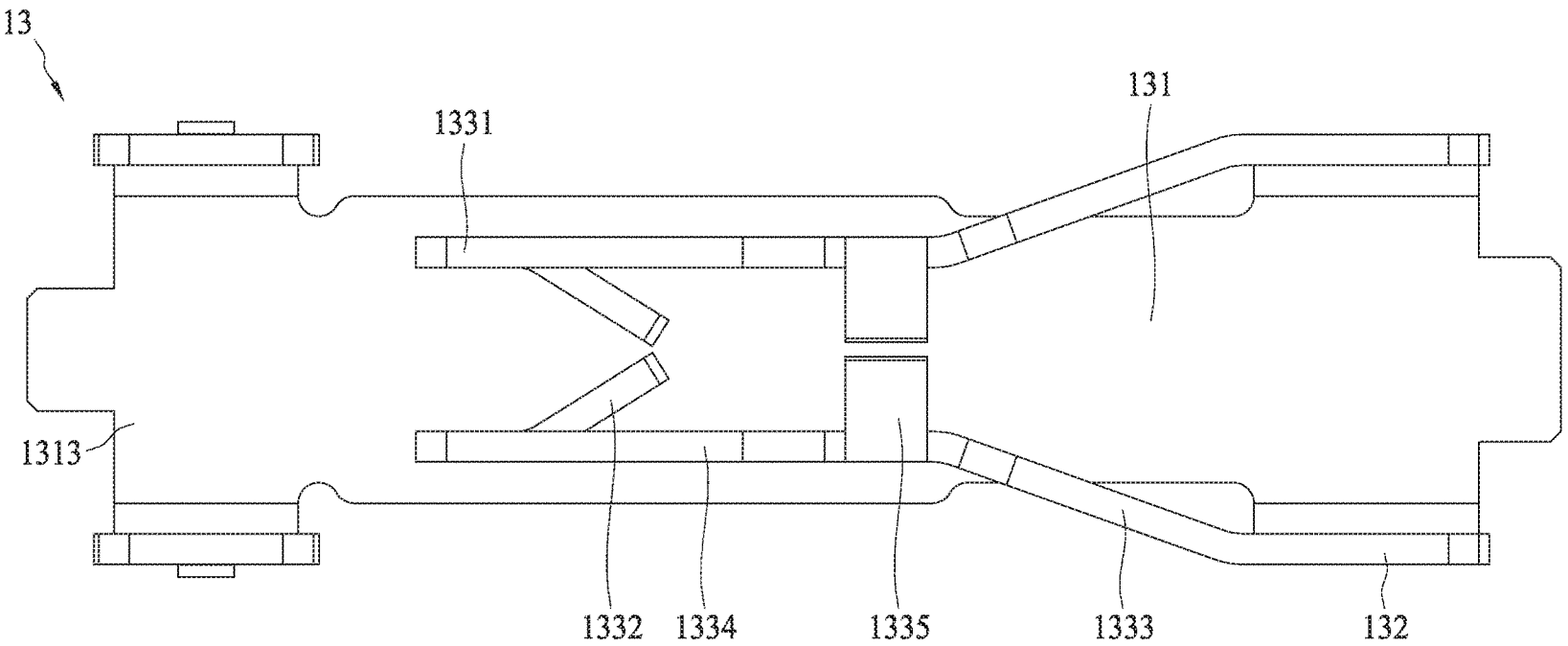
FIG. 7 is a top view of the conductive terminal depicted in FIG. 6.

FIG. 6 is a side view of the conductive terminal 13 of the embodiment of the present disclosure (where the electrical wire 10 is not presented), FIG. 7 is a top view of the conductive terminal 13 of the embodiment of the present disclosure (where the electrical wire 10 is not presented). In some embodiments, each elastic arm 133 comprises an inward taper portion 1333 and a forward extension portion 1334 extending forwardly. Each inward taper portion 1333 extends forwardly from the corresponding side portion 132 and extends from a position above an outer side of the base portion 131 toward a position above an inner side of the base portion 131; or the two inward taper portions 1333 of the two elastic arms 133 extend toward each other and taper toward each other. The forward extension portion 1334 extends forwardly from a front end of the inward taper portion 1333. In some embodiments, the two forward extension portions 1334 of the two elastic arms 133 are positioned above an upper surface 1313 of the base portion 131. In some embodiments, between two ends of the forward extension portion 1334 extending in the front-rear direction, the clamping portion 1332 of each elastic arm 133 is close to the front end 1331 of the forward extension portion 1334.

Figure 8:
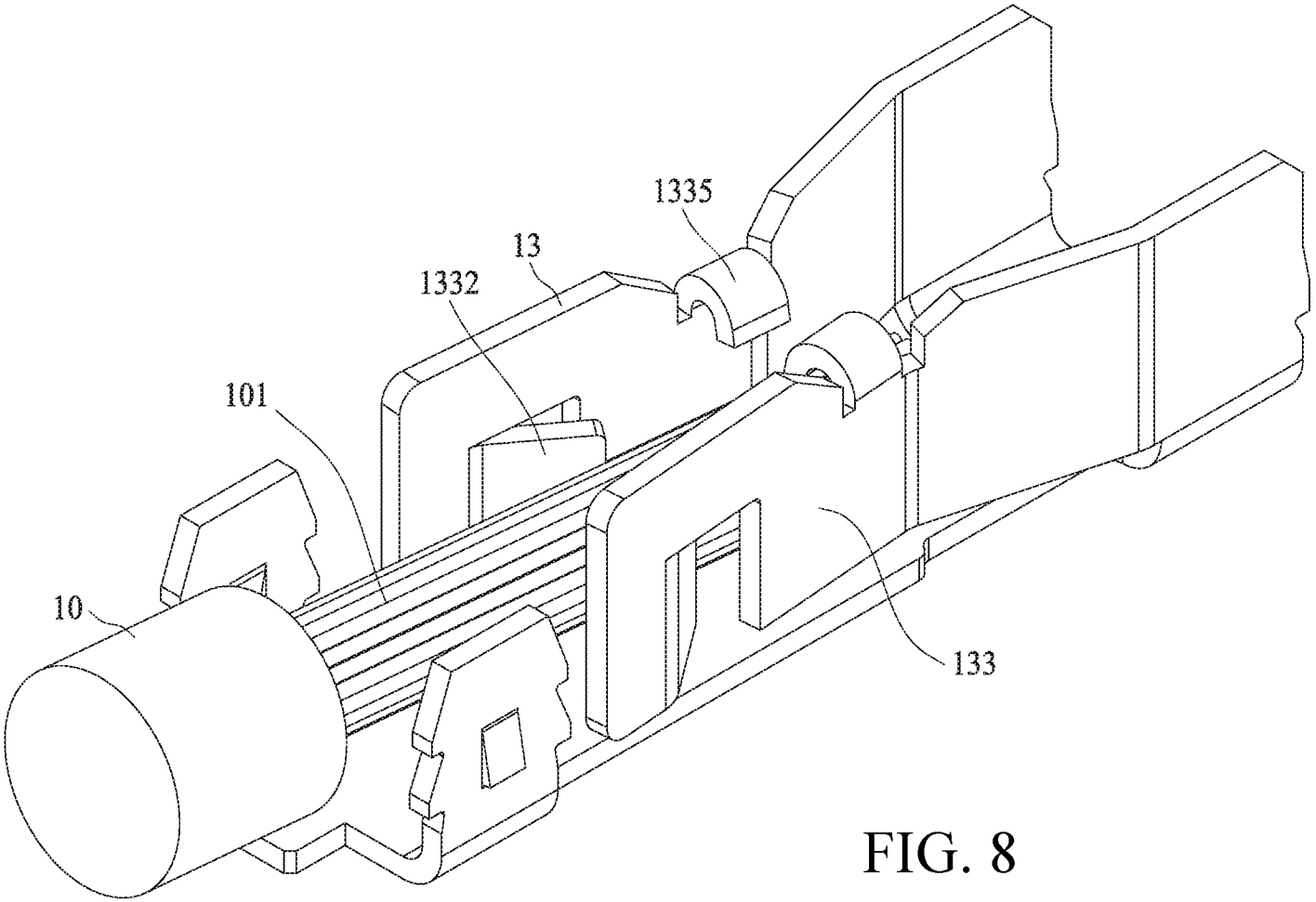
FIG. 8 is a perspective view illustrating an embodiment of conductive terminal clamping an electrical wire.
Figure 9:
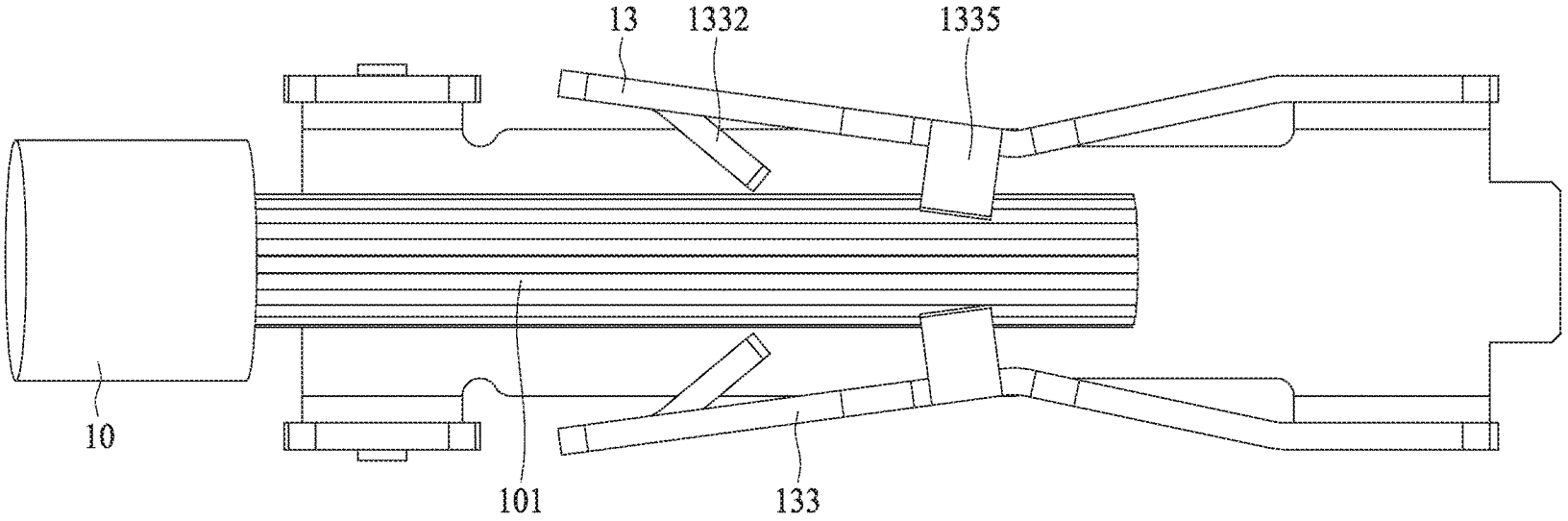
FIG. 9 is a top view illustrating the embodiment depicted in FIG. 8.

FIG. 8 is a perspective view illustrating that the conductive terminal 13 clamps the electrical wire 10 in the embodiment of the present disclosure, FIG. 9 is a top view illustrating that the conductive terminal 13 clamps the electrical wire 10 in the embodiment of the present disclosure. In some embodiments, when the conductor 101 of the electrical wire 10 is inserted into the conductive terminal 13, each elastic arm 133 of the conductive terminal 13 is pushed by the conductor 101 of the electrical wire 10 and is displaced outwardly, the two clamping portions 1332 at two sides of the conductor 101 clamp and fix the conductor 101 of the electrical wire 10 in the conductive terminal 13. In some embodiments, the two clamping portions 1332 of the two elastic arms 133 face each other and respectively extend obliquely and inwardly toward the rear, therefore the two clamping portions 1332 have a function capable of guiding the conductor 101, and the conductor 101 is clamped between two distal ends of the two clamping portions 1332.

Figure 10:
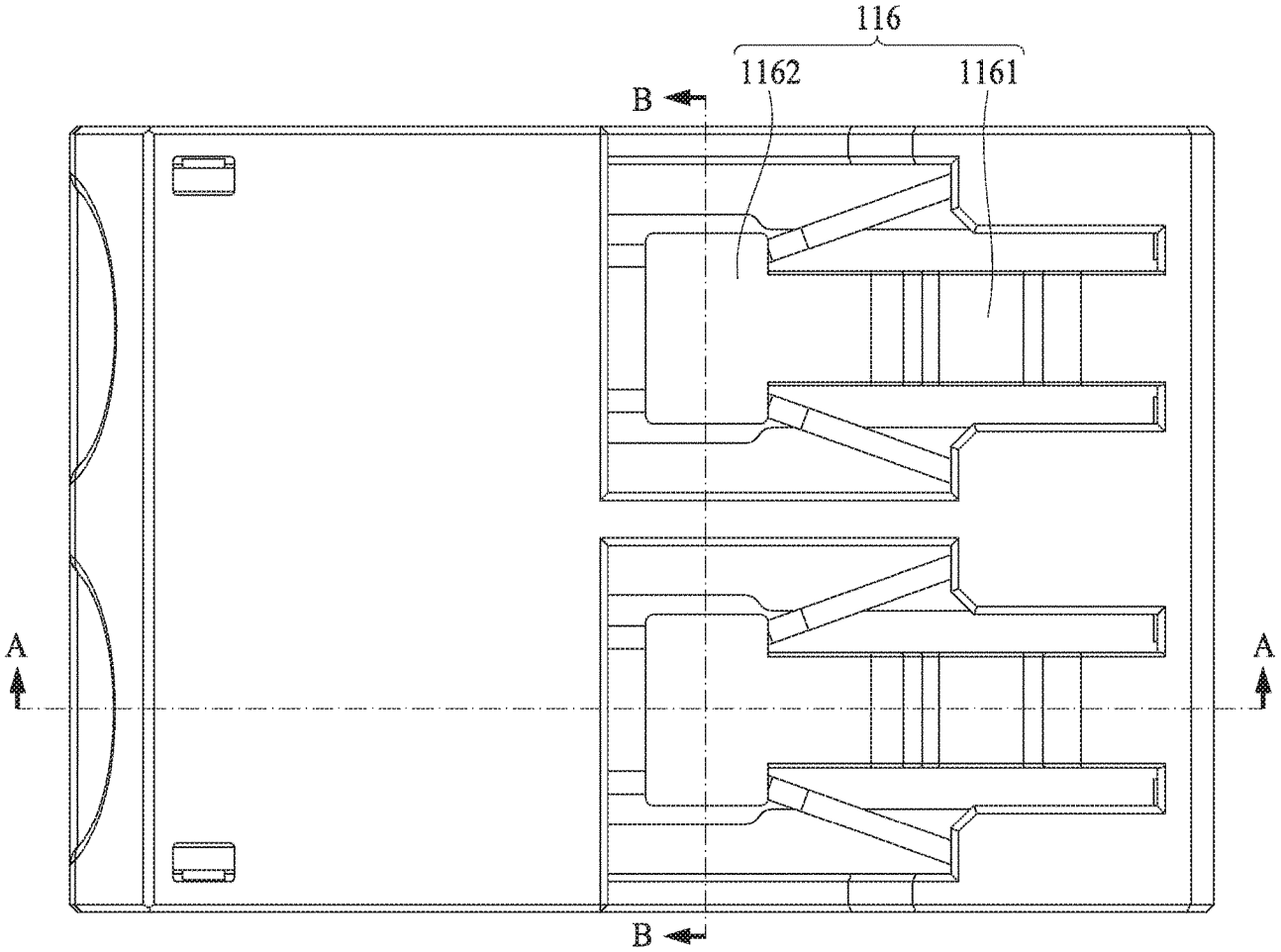
FIG. 10 is a top view of an embodiment of an electrical connector.
Figure 11:
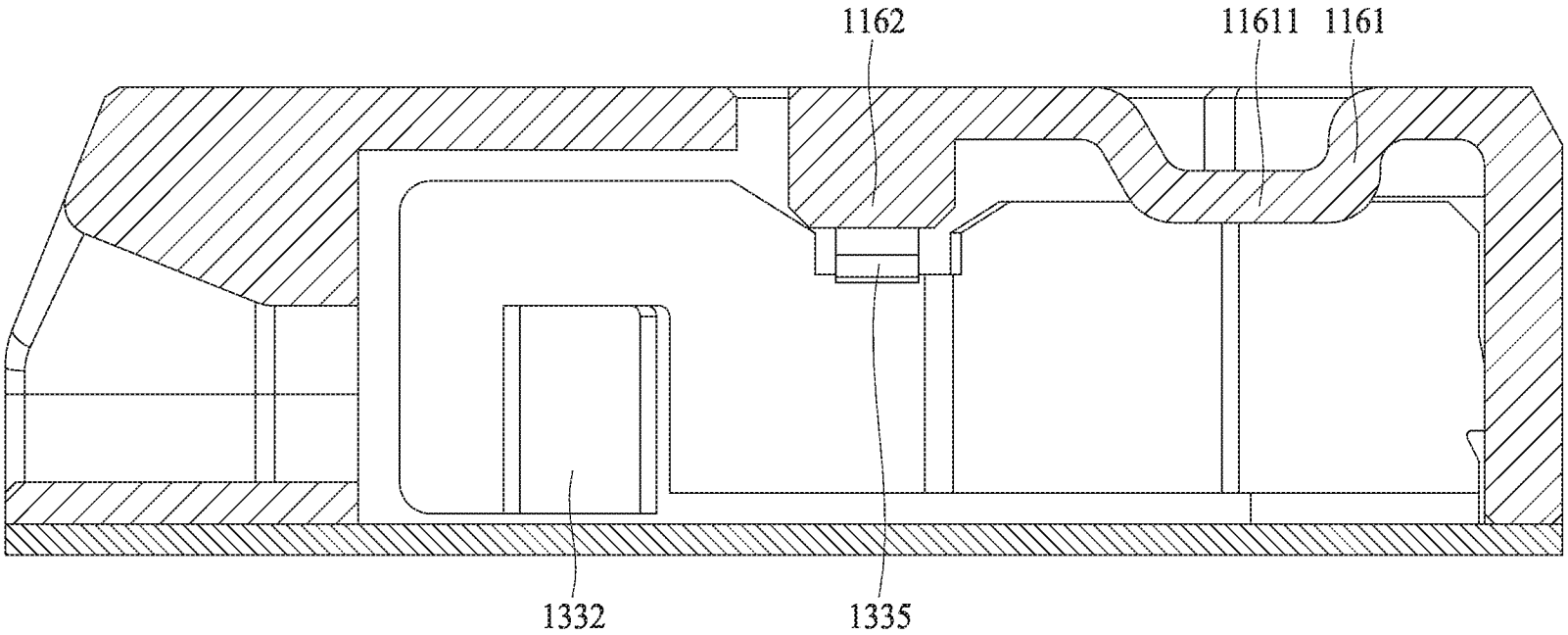
FIG. 11 is an elevated side view of a cross section of FIG. 10 taken along line A-A.
Figure 12:
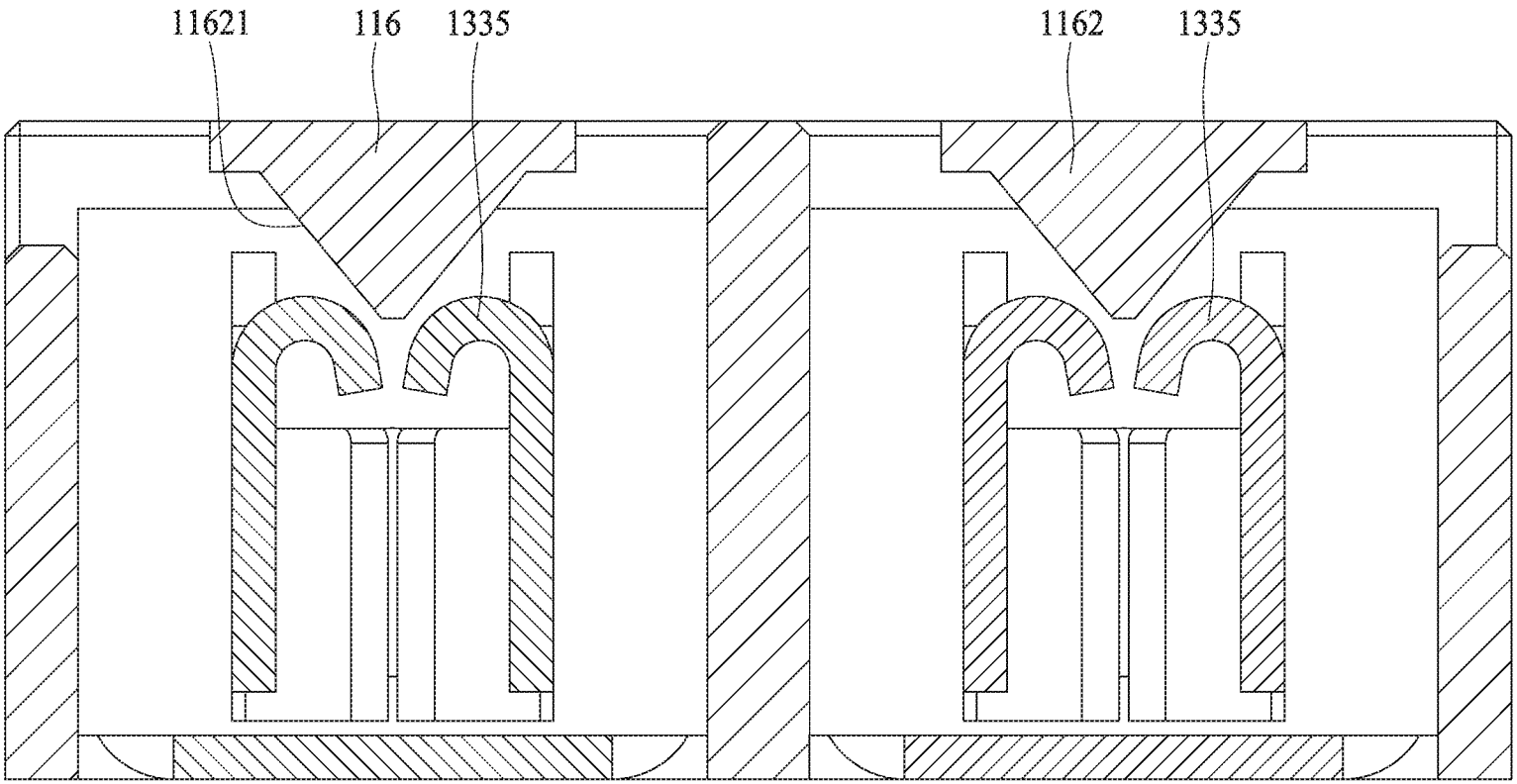
FIG. 12 is an elevated side view of a cross section of FIG. 10 taken along a line B-B.

FIG. 10 is a side view of the electrical connector 1 of the embodiment of the present disclosure (where the conductor 101 is not presented), FIG. 11 is a cross sectional view taken along a line A-A of FIG. 10, FIG. 12 is a cross sectional view taken along a line B-B of FIG. 10. In some embodiments, the housing 12 comprises at least one clamping released member 116. The clamping released member 116 may comprise an elastic connection arm 1161 and a clamping released block 1162. Each elastic arm 133 of each conductive terminal 13 comprises a pushed portion 1335 correspondingly provided under the clamping released block 1162. In some embodiments, the clamping released block 1162 comprises two side surfaces 11621 each tapering downwardly. In some embodiments, each pushed portion 1335 is a plate body bent inwardly and downwardly from an upper edge of the corresponding elastic arm 133. In some embodiments, the elastic connection arm 1161 may be an upright plate. In some embodiments, the elastic connection arm 1161 comprises a downward extending section or a downward recessed section 11611, therefore the elastic connection arm 1161 may have a larger elasticity. In some embodiments, the clamping released member 116 is integrally formed with the housing 12 and positioned at a top wall of the housing 12. The elastic connection arm 1161 of the clamping released member 116 is integrally formed as part of and extends forwardly from a rear end of the top wall of the housing 12 and the clamping released block 1162 is positioned at a front end of the elastic connection arm 1161.

Figure 13:
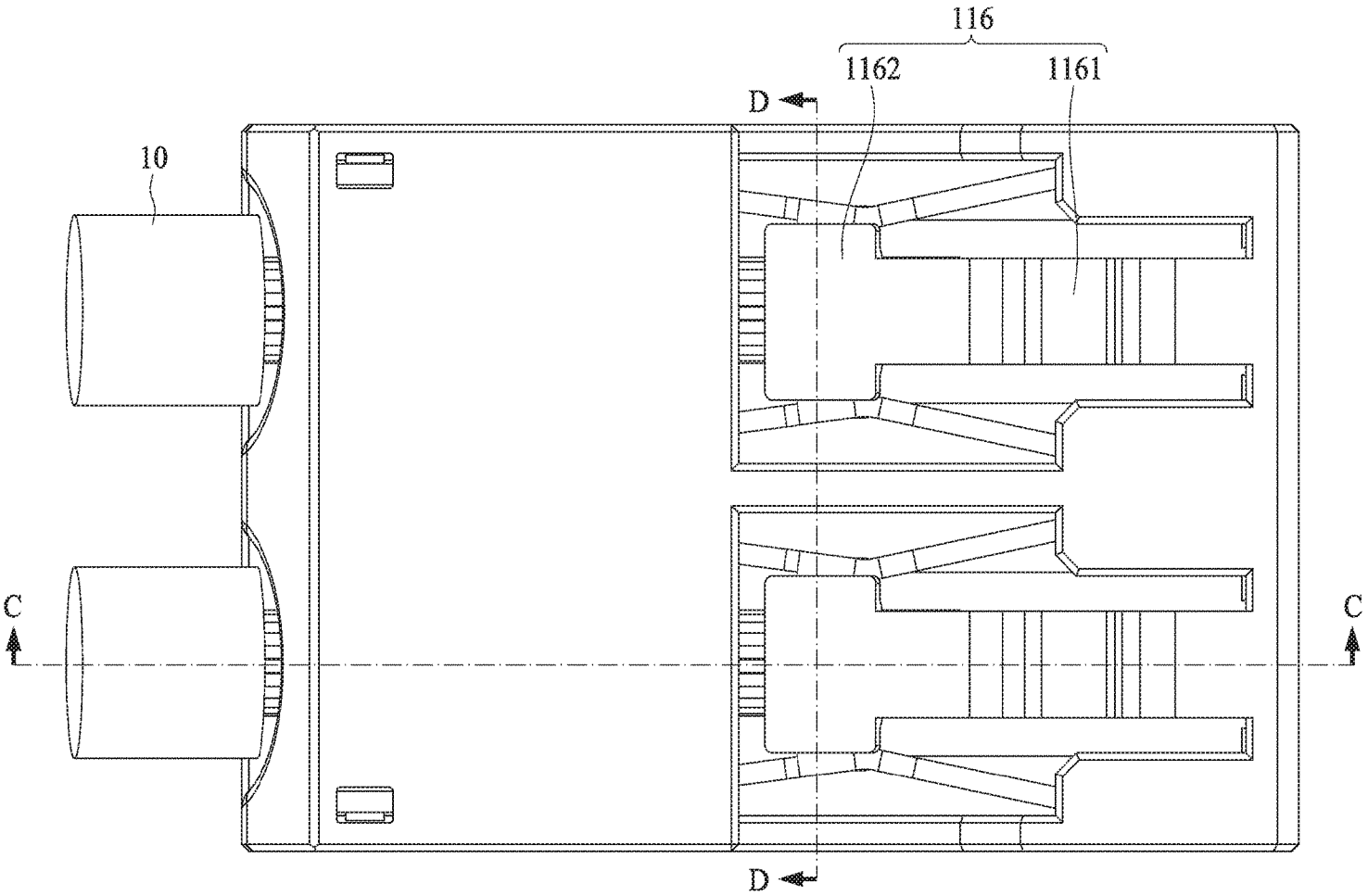
FIG. 13 is a top view of the embodiment depicted in FIG. 10 with inserted wires.
Figure 14:
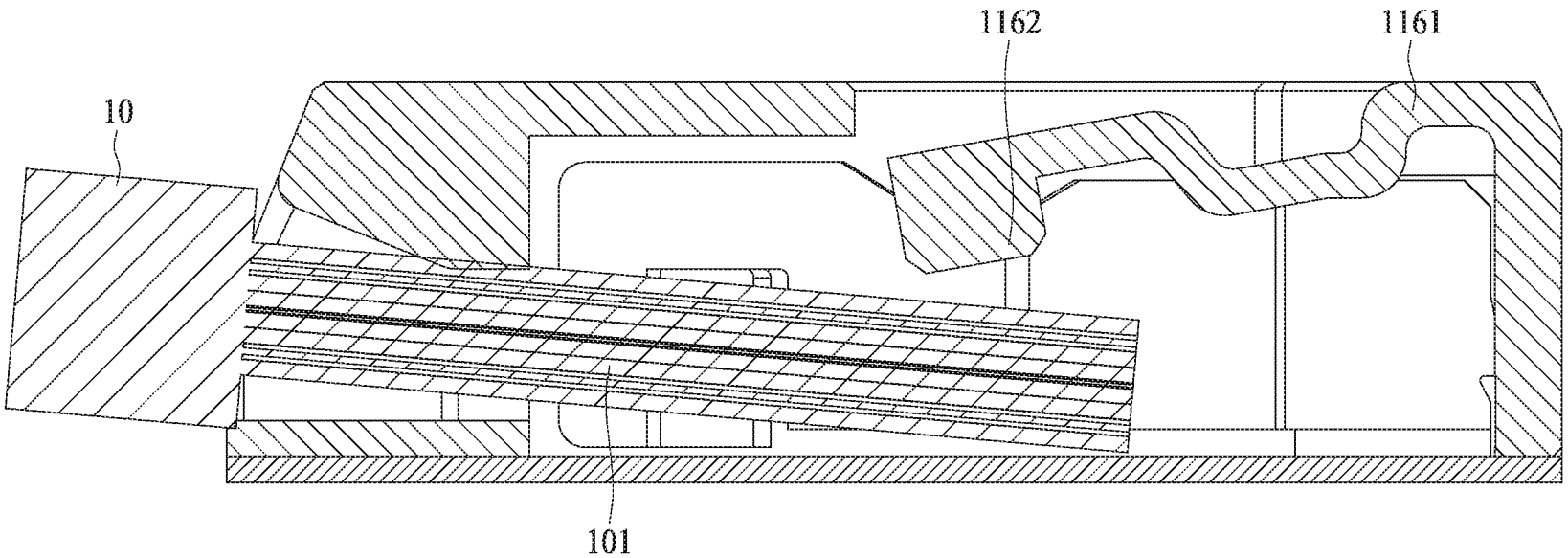
FIG. 14 is an elevated side view of a cross section of FIG. 13 taken along line C-C.
Figure 15:
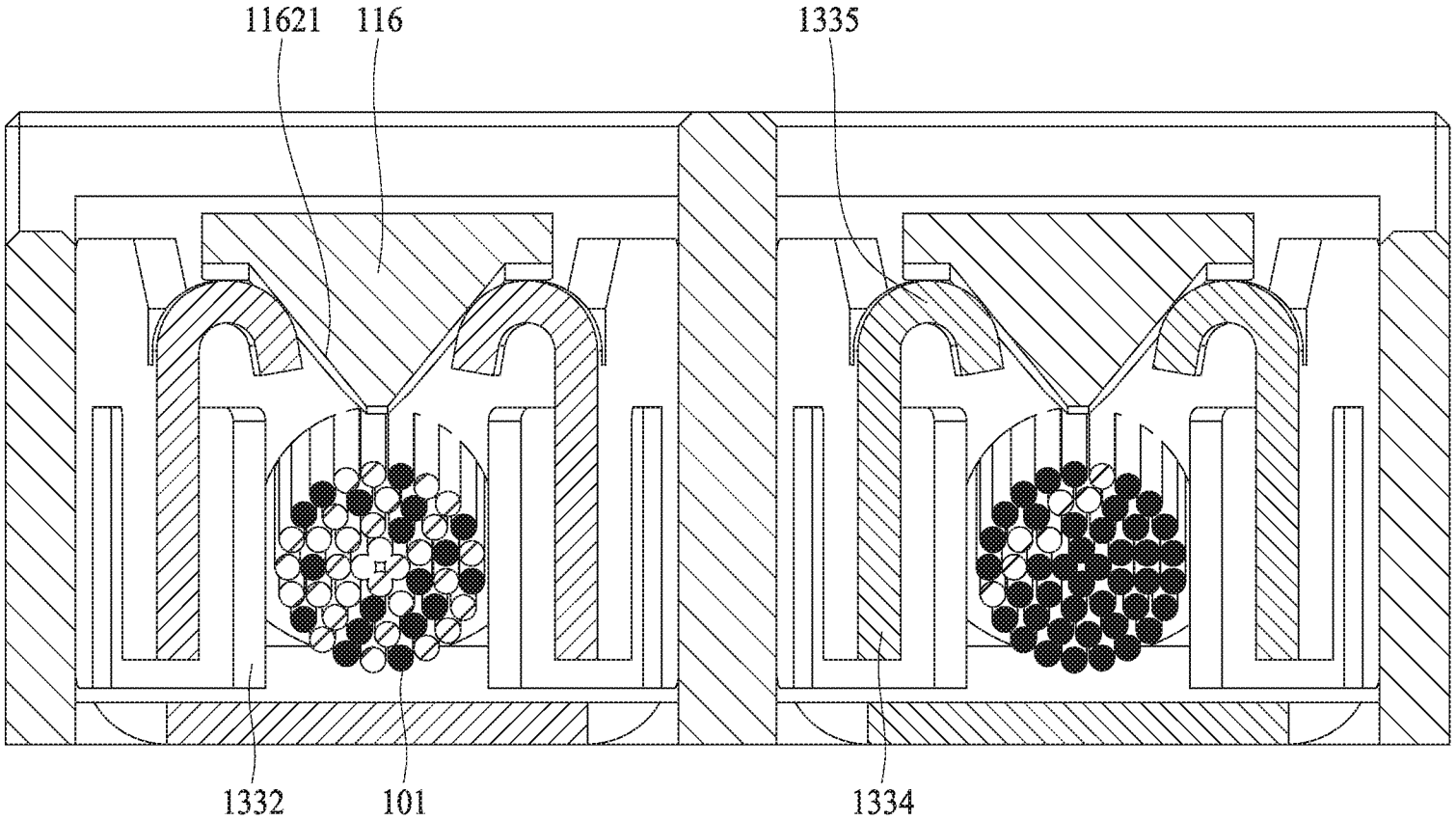
FIG. 15 is an elevated side view of a cross section of FIG. 13 taken along line D-D.

FIG. 13 is a side view illustrating that the electrical wire 10 is inserted into the electrical connector 1, FIG. 14 is a cross sectional view taken along a line C-C of FIG. 13, FIG. 15 is a cross sectional view taken along a line D-D of FIG. 13. In some embodiments, when the conductor 101 of the electrical wire 10 is inserted into the electrical connector 1, the two clamping portions 1332 of the conductive terminal 13 are pushed by the conductor 101 of the electrical wire 10 to allow each elastic arm 133 to be displaced outwardly, the two clamping portions 1332 at the two sides of the conductor 101 clamp and fix the conductor 101 of the electrical wire 10 in the conductive terminal 13. When the clamping released member 116 is pressed down, the elastic connection arm 1161 will bent downwardly, so as to allow the clamping released block 1162 to move downwardly, the two side surfaces 11621 of the clamping released block 1162 move into between the two pushed portions 1335 and respectively push outwardly the two pushed portions 1335 of the two elastic arms 133, the two pushed portions 1335 are respectively pushed by the two side surfaces 11621 to move outwardly, and in turn the two elastic arms 133 move outwardly respectively, so that a space between the two clamping portions 1332 is expanded, the part, which is stripped off the insulating layer 102 and clamped, of the conductor 101 of the electrical wire 10 may be released, so that the electrical wire 10 may be easily pulled out. In some embodiments, because the forward extension portion 1334 of each elastic arm 133 of each conductive terminal 13 extends above the base portion 131, if the pushed portion 1335 of the conductive terminal 13 is improperly pressed down by the clamping released member 116, the base portion 131 may stop the elastic arm 133 to be bent downwardly too much and in turn protect the conductive terminal 13.

Features of some embodiments are summarized in above content, so that a person skilled in the art may better understand various aspects of the disclosed content of the present disclosure. A person skilled in the art of the present disclosure shall understand that the disclosed content of the present disclosure may be easily used to design or modify other manufacturing approach or configuration and in turn to realize the same object and/or attain the same advantage as the embodiments of the present disclosure. A person skilled in the art of the present disclosure shall also understand that, such an equivalent approach or configuration cannot be departed from the spirit and scope of the disclosed content of the present disclosure, and a person skilled in the art may make various changes, substitutions and replacements, which are not departed from the spirit and scope of the disclosed content of the present disclosure.

The invention claimed is:

1. An electrical connector comprising:

a housing with a terminal slot and an insertion entrance in front of the terminal slot; and a conductive terminal mounted in the terminal slot, the conductive terminal comprising a base portion, two side portions and two elastic arms, the base portion extending in a first direction, the two side portions extending upwardly respectively at two sides of a rear end of the base portion, the two elastic arms extending respectively from the two side portions toward the insertion entrance of the housing direction, a front end of each elastic arm being close to the insertion entrance, a clamping portion being formed close to the front end of the each elastic arm by punching out a tab in each elastic arm.

2. The electrical connector according to claim 1, wherein each elastic arm comprises an inward taper portion and a forward extension portion extending forwardly, the two inward taper portions of the two elastic arms taper toward each other.

3. The electrical connector according to claim 2, wherein the two clamping portions of the two elastic arms face each other and respectively extend obliquely and inwardly toward the rear.

4. The electrical connector according to claim 3, wherein the two forward extension portions of the two elastic arms are positioned above an upper surface of the base portion.

5. The electrical connector according to claim 1, wherein the housing comprises at least one clamping released member, the clamping released member comprises an elastic connection arm and a clamping released block, each the elastic arm of the conductive terminal comprises a pushed portion, when the clamping released member is pressed down, the clamping released block pushes outwardly the two pushed portions so as to allow a space between the two clamping portions to be expanded.

6. The electrical connector according to claim 5, wherein each pushed portion is a plate body bent inwardly and downwardly from an upper edge of the corresponding elastic arm, the clamping released block comprises two side surfaces tapering downwardly.

7. The electrical connector according to claim 6, wherein the elastic connection arm of the clamping released member integrally extends forwardly from a rear end of a top wall of the housing, the clamping released block is positioned at a front end of the elastic connection arm, the elastic connection arm comprises a downward extending section.

8. An electrical connector configured to receive an electrical wire, the electrical connector comprising:

an housing, the housing comprising at least one terminal slot, and the housing comprising an insertion entrance in front of the terminal slot for insertion of a conductor of the electrical wire; and at least one conductive terminal, the conductive terminal being correspondingly mounted to the terminal slot, the conductive terminal comprising a base portion, two side portions and two elastic arms, the base portion extending in a front-rear direction, the two side portions extending upwardly respectively at two sides of a rear end of the base portion, the two elastic arms extending respectively from the two side portions toward the insertion entrance of the housing in a rear-to-front direction, a front end of each elastic arm being close to the insertion entrance, a clamping portion being formed close to the front end of the each elastic arm by punching a tab in each elastic arm, the clamping portion being used to clamp a part of the conductor of the electrical wire stripped off an insulating layer.

9. The electrical connector according to claim 8, wherein each elastic arm comprises an inward taper portion and a forward extension portion extending forwardly, the two inward taper portions of the two elastic arms taper toward each other.

10. The electrical connector according to claim 9, wherein the two clamping portions of the two elastic arms face each other and respectively extend obliquely and inwardly toward the rear.

11. The electrical connector according to claim 10, wherein the two forward extension portions of the two elastic arms are positioned above an upper surface of the base portion.

12. The electrical connector according to claim 8, wherein the housing comprises at least one clamping released member, the clamping released member comprises an elastic connection arm and a clamping released block, each the elastic arm of the conductive terminal comprises a pushed portion, when the clamping released member is pressed down, the clamping released block pushes outwardly the two pushed portions so as to allow a space between the two clamping portions to be expanded.

13. The electrical connector according to claim 12, wherein each pushed portion is a plate body bent inwardly and downwardly from an upper edge of the corresponding elastic arm, the clamping released block comprises two side surfaces tapering downwardly.

14. The electrical connector according to claim 13, wherein the elastic connection arm of the clamping released member integrally extends forwardly from a rear end of a top wall of the housing, the clamping released block is positioned at a front end of the elastic connection arm, the elastic connection arm comprises a downward extending section.

* * * * *